US009343789B2

(12) United States Patent
Yu et al.

(10) Patent No.: US 9,343,789 B2
(45) Date of Patent: May 17, 2016

(54) COMPACT MICROSTRIP BANDPASS FILTER WITH MULTIPATH SOURCE-LOAD COUPLING

(71) Applicant: Zhejiang University, Hangzhou (CN)

(72) Inventors: Faxin Yu, Hangzhou (CN); Qin Zheng, Hangzhou (CN); Zhiyu Wang, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 155 days.

(21) Appl. No.: 14/068,314

(22) Filed: Oct. 31, 2013

(65) Prior Publication Data

US 2015/0116059 A1 Apr. 30, 2015

(51) Int. Cl.
*H01P 1/203* (2006.01)
*H01P 7/08* (2006.01)

(52) U.S. Cl.
CPC ..... *H01P 1/20381* (2013.01); *H01P 1/20345* (2013.01); *H01P 7/082* (2013.01); *Y10T 29/49155* (2015.01)

(58) Field of Classification Search
CPC . H01P 1/203; H01P 1/20327; H01P 1/20381; H01P 1/2039; H01P 7/082
USPC ..... 333/204, 205, 219, 235, 34, 35, 33
See application file for complete search history.

(56) References Cited

U.S. PATENT DOCUMENTS

| | | | | |
|---|---|---|---|---|
| 8,125,302 | B2 * | 2/2012 | Kawai et al. | 333/205 |
| 2007/0069838 | A1 * | 3/2007 | Kayano | H01P 1/20381 333/204 |
| 2007/0176713 | A1 * | 8/2007 | Mukaiyama et al. | 333/219 |
| 2007/0241839 | A1 * | 10/2007 | Taniguchi | 333/185 |
| 2014/0035703 | A1 * | 2/2014 | Ma et al. | 333/204 |

OTHER PUBLICATIONS

Zhang et al., "Design of Microstrip Dual-Mode Filters Based on Source-Load Coupling" IEEE Microwave and Wireless Components Letters , vol. 18, No. 10, Oct. 2008, pp. 677-679.
Hua et al., "Microstrip Bandpass Filters Using Dual-Mode Resonators with Internal Coupled Lines" Progress in Electromagnetics Research C, vol. 21, 2011, pp. 99-111.
Lee et al., "New Compact Bandpass Filter using Microstrip λ/4 Resonators with Open Stub Inverter" IEEE Microwave and Guided Wave Letters, vol. 10, No. 12, Dec. 2000, pp. 526-527.
(Continued)

*Primary Examiner* — Robert Pascal
*Assistant Examiner* — Gerald Stevens
(74) *Attorney, Agent, or Firm* — Gesmer Updegrove LLP

(57) ABSTRACT

A method and device for a compact microstrip bandpass filter that includes an input terminal, an output terminal, a plurality of quarter-wavelength resonators, a resonant disk, a plurality of layers, and a microstrip line which connects the resonant disk to a joint point of the quarter-wavelength resonators. A method of forming two signal paths in a compact microstrip bandpass filter includes forming a first signal path between an input terminal and an output terminal of the filter with a plurality of quarter-wavelength resonators with a resonant disk and a microstrip line which connects the resonant disk to a joint point of the quarter-wavelength resonators. The method includes forming a second signal path of the quarter-wavelength resonators, the filter includes a plurality of layers.

29 Claims, 6 Drawing Sheets

(56) References Cited

OTHER PUBLICATIONS

Wei et al., "Design of Different Selectivity Dual-Mode Filters with E-Shaped Resonator" Progress in Electromagnetics Research, vol. 116, 2011, pp. 517-532.

Liao et al., "Microstrip Realization of Generalized Chebyshev Filters with Box-Like Coupling Schemes" IEEE Transactions on Microwave Theory and Techniques, vol. 55, No. 1, Jan. 2007, pp. 147-153.

Gao et al., "Miniaturized Microstrip Dual-Mode Filter With Three Transmission Zeros" Progress in Electromagnetics Research Letters, vol. 31, 2012, pp. 199-207.

Rosenberg, "Novel Coupling Schemes for Microwave Resonator Filters" IEEE Transactions on Microwave Theory and Techniques, vol. 50, No. 12, Dec. 2002, pp. 2896-2902.

Boutejdar et al., "Compact Bandpass Filter Structure Using an Open Stub Quarter-Wavelength Microstrip Line Corrections" Microwave Conference, 2005, European vol. 2, Oct. 4-6, 2005, 3 pages.

* cited by examiner

COMPACT MICROSTRIP BANDPASS FILTER WITH MULTIPATH SOURCE-LOAD COUPLING

BACKGROUND OF THE INVENTION

This invention is related to a microstrip bandpass filter, and in particular to a compact microstrip bandpass filter with multipath source-load coupling.

In modern microwave communication systems, like satellite and mobile communication systems, compact microwave bandpass filters with low passband insertion loss and high stopband rejection are required. Due to current processing technologies of integrated circuits, bandpass filters based on planar techniques, like microstrip bandpass filters, are most commonly used in practical applications. Bandpass filters consist of planar resonators, such as split ring, miniaturized hairpin, stepped-impedance and parallel-coupled resonators, have been proposed for either performance improvement or size reduction. However, most of the applied bandpass filters face a tradeoff between low passband insertion loss and high stopband rejection. As a result, most of them have a passband insertion loss of over −2 dB when reaching a relatively high stopband rejection, like −30 dB, and conversely, have a low stopband rejection when approaching a smaller passband insertion loss.

Moreover, due to the rapid growth of the spectrum occupation and the growing demand for higher receiver sensitivity, bandpass filters with a wider upper or lower stopband in the adjacent frequency band are required to reduce interference between signal channels, which introduce an additional challenge for the design of high-performance bandpass filters. According to early researches, bandpass filters with couplings between the input and output terminals provide a number of alternative paths which a signal may take. Depending on the phasing of the signals, plural transmission poles in the stopband are achievable through multipath effect, which can be used in the optimization of exhibiting ripples in both passband and stopband.

SUMMARY OF THE INVENTION

According to one aspect of the invention, there is provided a compact microstrip bandpass filter. The compact microstrip bandpass filter includes an input terminal, an output terminal, a plurality of quarter-wavelength resonators, a resonant disk, a plurality of layers, and a microstrip line which connects the resonant disk to a joint point of the quarter-wavelength resonators.

According to another aspect of the invention, there is provided a method of forming two signal paths in a compact microstrip bandpass filter. The method includes forming a first signal path between an input terminal and an output terminal of the filter with a plurality of quarter-wavelength resonators with a resonant disk and a microstrip line which connects the resonant disk to a joint point of the quarter-wavelength resonators. The method includes forming a second signal path of the quarter-wavelength resonators, the filter includes a plurality of layers.

According to another aspect of the invention, there is provided a method for forming a compact microstrip bandpass filter comprising the steps of providing an input terminal, an output terminal, a plurality of quarter-wavelength resonators, a resonant disk, a plurality of layers, and a microstrip line for connecting the resonant disk to a joint point of the quarter-wavelength resonators.

DETAILED DESCRIPTION OF THE INVENTION

The invention involves a compact microstrip bandpass filter with multipath source-load coupling which has less than −1.07 dB passband insertion loss and more than −30 dB stopband rejection.

Figure 1:
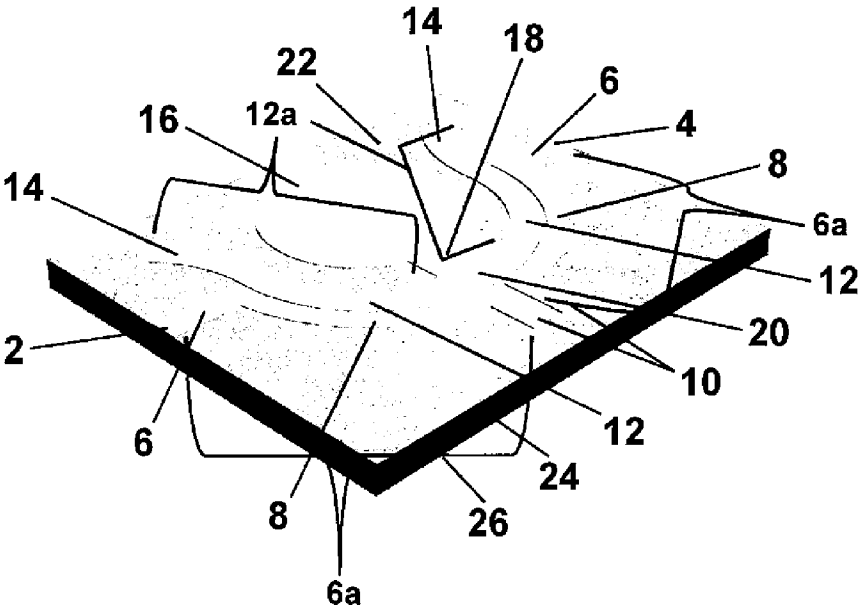
FIG. 1 is an illustration of the present compact microstrip bandpass filter.

FIG. 1 is an illustration of the present compact microstrip bandpass filter. In FIG. 1, the compact microstrip bandpass filter comprises an input terminal 2, an output terminal 4, a plurality of, for example, two quarter-wavelength resonators 6, 8, 10, 12, 14, a resonant disk 16, a microstrip line 18 which connects the resonant disk 16 to a joint point 20 of the two quarter-wavelength resonators 6, 8, 10, 12, 14, dielectric layers 22, 24 and a ground layer 26. The whole filter has a mirror symmetry along a perpendicular bisector of the line segment connecting the two terminals 2, 4. Each quarter-wavelength resonator 6, 8, 10, 12, 14 includes a first arm 6*a* which includes sections 6, 8, 10 and a second arm 12*a* which includes sections 12, 14. One end 6 of the outside arm 6*a* is connected with one of the two terminals 2, 4, while the other end 10 of the outside arm 6*a* forms a capacitor in a middle section 8. The middle section 8 of the outside arm 6*a* is coupled with one end 12 of the inside arm 12*a*. The inside arms 12*a* from both quarter-wavelength resonators 6, 8, 10, 12, 14 are connected at the joint point 20. The resonant disk 16 and the microstrip line 18 form an open stub 16, 18, which is connected to the joint point 20. The open stub 16, 18 is used as a replacement of a metallic via which is widely used in conventional filters to short the joint point 20 to the ground.

Figure 2:
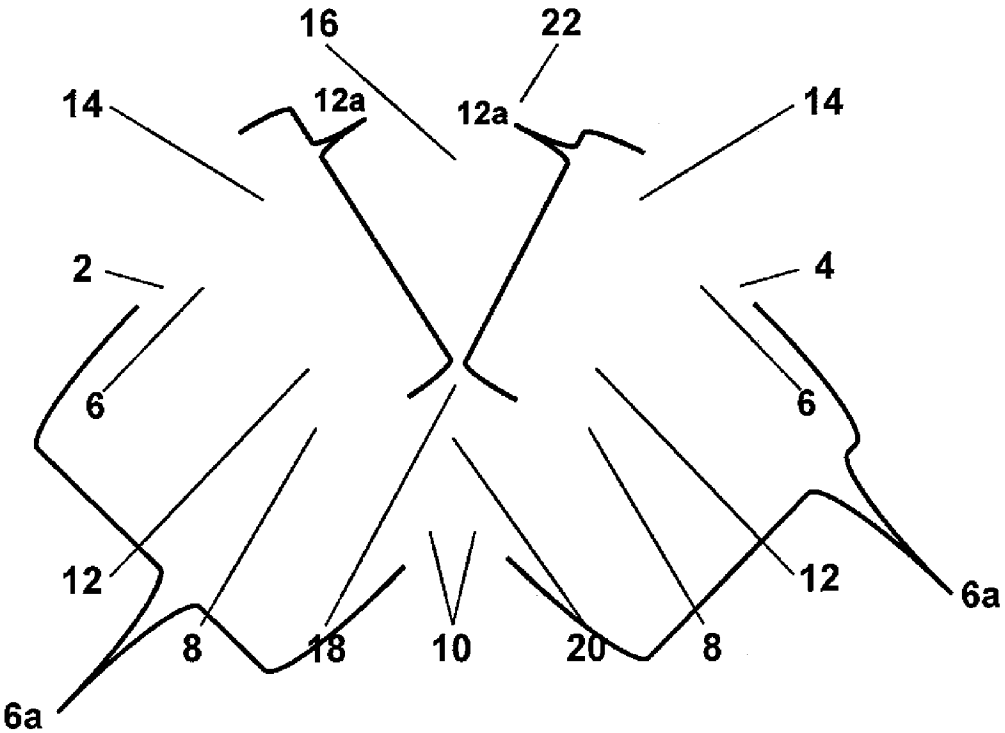
FIG. 2 is a plan view of the compact microstrip bandpass filter shown in FIG. 1.

FIG. 2 is a plan view of the compact microstrip bandpass filter shown in FIG. 1. The lengths of both arms 6*a* and 12*a* in each quarter-wavelength resonator 6, 8, 10, 12, 14 are around the quarter wavelength in the microstrip 18 line at the central frequency of the passband. The end 12 of the inside arm 12*a* and the middle section 8 of the outside arm 6*a* are curved around the resonant disk 16 with different radii. The other end 14 of the inside arm 12*a* has the opposite curvature and the same radii with the end 12. Due to the fact that wave propagating in a wider microstrip line has shorter wavelength, the width of the inside arm 12*a* is set to be larger than the width of the outside arm 6*a*. As a result, the wave propagating in both arms 6*a* and 12*a* can phase equally. The sharp turnings formed by the edges of the microstrip line 18 and the inside edges of the arms 12*a* are smoothed into two round corners, in order to reduce the surface current density at the joint point 20 and through the open stub 16, 18, so as to achieve a low passband insertion loss.

Figure 3:
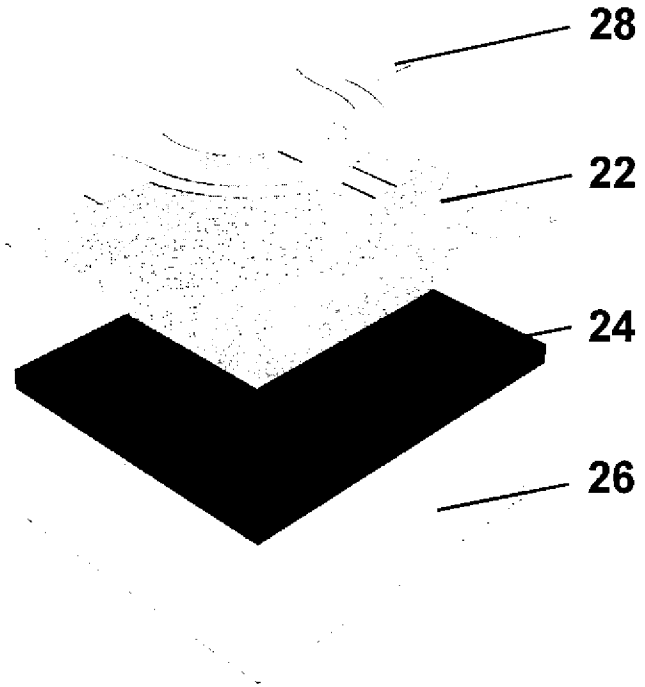
FIG. 3 is a schematic diagram illustrating different layers of the compact microstrip bandpass filter shown in FIG. 1.

FIG. 3 is a schematic diagram illustrating different layers of the compact microstrip bandpass filter as shown in FIG. 1, and there exists, for example, an arrangement of four layers. The top layer is a metallic layer 28 which contains a pattern of the present compact microstrip bandpass filter. The bottom layer is another metallic layer 26 which is used as the ground layer. Between these two layers 26 and 28 are two dielectric layers 22, 24. A bottom dielectric layer 24 is used as a dielectric substrate while atop dielectric layer 22 is a passivation layer positioned between the metallic layer 28 and the bottom dielectric layer 24. The top dielectric layer 22 is an optional layer which is used to protect the electric properties of the bottom dielectric layer 24.

The two quarter-wavelength resonators 6, 8, 10, 12, 14 are cascaded and may introduce a first reflection pole in the passband. The resonant frequency of the open stub 16, 18 formed by the resonant disk 16 and the microstrip line 18 is designed to be close to the frequency of the first reflection pole. When the open stub 16, 18 is attached to the joint point 20, a second reflection pole in the passband and a transmission pole in the stopband are formed, which can be optimized to obtain a high performance of the passband.

In order to further reduce the interference between adjacent signal channels, a wider upper or lower stopband is required to suppress the undesired transmission components in the stopband of the present compact microstrip bandpass filter. In the present invention, multipath coupling method is utilized to create multiple transmission poles in the stopband so that a stopband-extended bandpass filter can be realized with improved stopband rejection.

Bandpass filters with multipath coupling between the input and output terminals provide a number of alternative paths which a signal may take. Depending on the phasing of the signals, plural transmission poles in the stopband are achievable through multipath effect, which can be used in the optimization of exhibiting ripples in both passband and stopband.

In the present invention, a method of forming two signal paths between the input and output terminals 2, 4 of the present bandpass filter is provided. One signal path is formed with the two quarter-wavelength resonators 6, 8, 10, 12, 14 with a resonant disk 16 connected to the joint point as an open stub 16, 18, in which a first signal travels through a first coupling path between the middle section 8 of the outside arm 6*a*, and the end 12 of the inside arm 12*a* on one side of the perpendicular bisector of the line segment connecting the two terminals 2, 4, and then travels through a second coupling path at the symmetric position on the other side of the perpendicular bisector. In order to introduce an additional coupling path between the input and output terminals 2, 4, the end 10 of the outside arm 6*a* is curved to form a capacitor. The second signal path is then formed with the two outside arms 6*a* of the two quarter-wavelength resonators 6, 8, 10, 12, 14 in which a second signal travels along the two outside arms 6*a* via the capacitive coupling path between the two ends 10 of the outside arms 6*a*, without entering the inside arms 12*a*. The capacitive coupling through the capacitor gives rise to a second transmission pole at the same side of the passband, which can be optimized to greatly enhance the stopband performance while keeping the high performance of the passband. The relative signal phasing between these two signal paths is tunable by changing the relative position of the two arms in each quarter-wavelength resonator 6, 8, 10, 12, 14, which is used to optimize the passband and stopband performance of the bandpass filter.

A practical embodiment of the present compact microstrip bandpass filter is simulated using a commercial full-wave finite-element simulator (High Frequency Simulator Structure (HFSS)). The central frequency of the compact microstrip bandpass filter is chosen as, for example, 24.11 GHz. A layer of GaAs, for example, is used as the bottom dielectric layer 24, the relative dielectric constant of which is 12.9. A thin film of SiN, for example, is used as the second dielectric layer 22. And a layer of gold, for example, with conductivity 4.1e7 S/m is used as the top metallic layer 28.

Figure 4A:
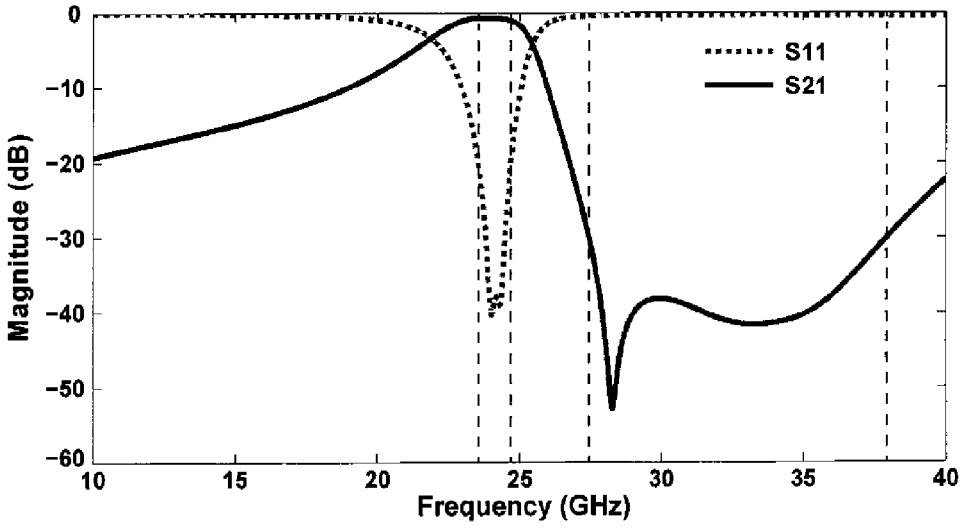
FIGS. 4A, 4B, and 4C are graphs of the simulated S parameters of the compact microstrip bandpass filter shown in FIG. 1.
Figure 4B:
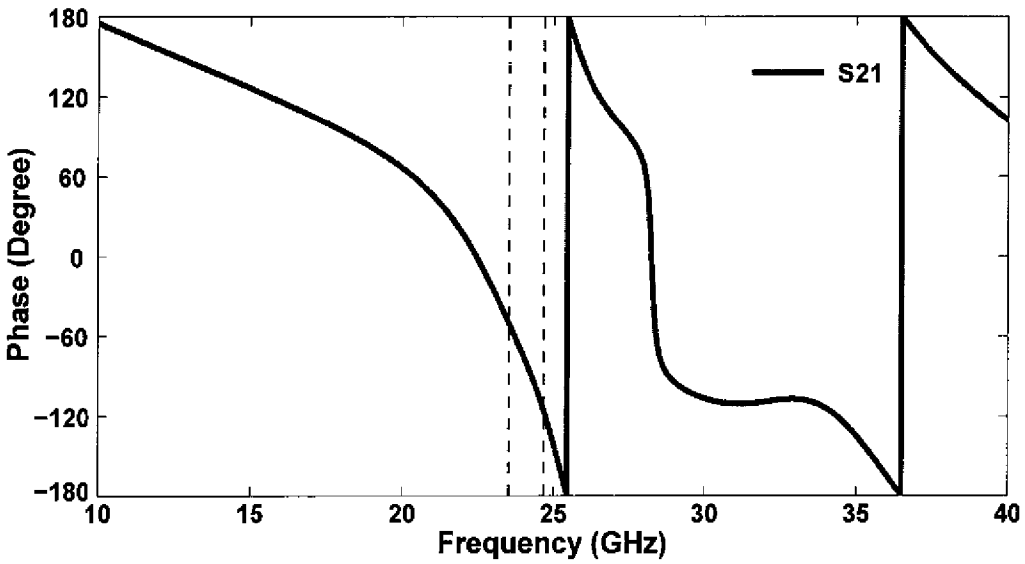
Figure 4C:
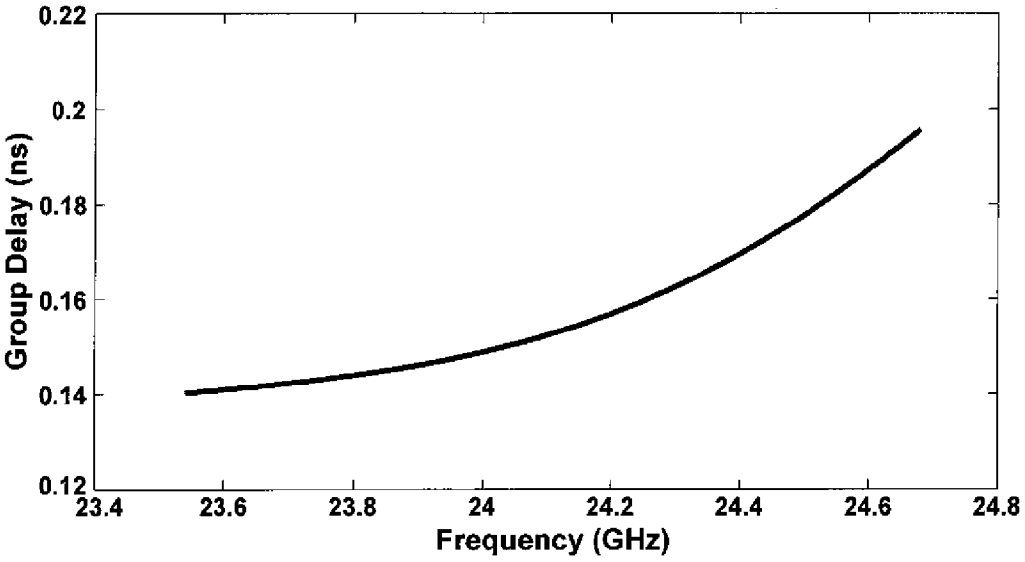

FIGS. 4A, 4B, and 4C are graphs of the simulated S parameters of the compact microstrip bandpass filter shown in FIG. 1, where FIG. 4A shows the magnitudes of the S11 and S21, FIG. 4B shows the phases of the S21, and FIG. 4C shows the group delay in the passband. The practical embodiment is optimized for low passband insertion loss and high upper stopband rejection. Each of these figures are further described below.

In FIG. 4A, the bandwidth of the passband with less than −1.07 dB insertion loss and more than −20 dB return loss is about 1.14 GHz, from 23.54 GHz to 24.68 GHz. The passband ripple is less than 0.33 dB, corresponding to the range of passband insertion loss from −0.74 dB to −1.07 dB. The passband voltage standing wave ratio (VSWR) is less than 1.22 and the bandwidth of the upper stopband with more than −30 dB rejection is 10.5 GHz, from 27.44 GHz to 37.94 GHz.

In FIG. 4B, the phase changing in the passband from 23.54 GHz to 24.68 GHz shows high linearity. FIG. 4C shows the group delay in this frequency band which is derived from the data in FIG. 4B. In FIG. 4C, the maximum difference of the group delay is 0.056 ns, which proves the validity of the high phase linearity.

Due to the existence of the two transmission poles in the stopband, the present compact microstrip bandpass filter is robust. When the accuracy of fabrication is not high enough, traditional bandpass filter with only one transmission pole in the stopband often loses its high performance of the stopband. The transmission peak in the stopband is then raised up to above −20 dB or even above −15 dB. Whereas the high stopband performance of the present compact microstrip bandpass filter does not rely on the high accuracy of fabrication. The transmission peak in the stopband is limited by the two transmission poles on both sides and will stay below −30 dB.

Although the present invention has been shown and described with respect to several preferred embodiment thereof, various changes, omissions and additions to the form and detail thereof, may be made therein, without departing from the spirit and scope of the invention.

What is claimed is:

1. A compact microstrip bandpass filter comprising:

an input terminal, an output terminal, a plurality of quarter-wavelength resonators, a resonant disk, a plurality of layers, and a microstrip line which connects the resonant disk to a joint point of the quarter-wavelength resonators, wherein the resonant disk and the microstrip line form an open stub, which is connected to the joint point where a rounded corner is used to connect the open stub to the joint point and the width of the microstrip line of the open stub is increased to reduce surface current density at the joint point and through the open stub.

2. The compact microstrip bandpass filter of claim 1, wherein said filter has a mirror symmetry along a perpendicular bisector of a line segment connecting said terminals.

3. The compact microstrip bandpass filter of claim 1, wherein each quarter-wavelength resonator comprises a first arm and a second arm.

4. The compact microstrip bandpass filter of claim 3, wherein a first end of at least one of the first arms is connected with one of said terminals.

5. The compact microstrip bandpass filter of claim 3, wherein the second arms of the quarter-wavelength resonators are connected at the joint point.

6. The compact microstrip bandpass filter of claim 3, wherein the lengths of the first arm and the second arm in each quarter-wavelength resonator are around a quarter wavelength in the microstrip line at a central frequency of the passband.

7. The compact microstrip bandpass filter of claim 3, wherein a width of at least one of the second arms is larger than a width of at least one of the first arms.

8. The compact microstrip bandpass filter of claim 3, wherein the quarter-wavelength resonators with the resonant disk connected to the joint point as the open stub forms a first signal path, in which a first signal travels through a coupling path between at least one of said first arms and at least one of said second arms of the quarter-wavelength resonators.

9. The compact microstrip bandpass filter of claim 3, wherein the first and second arms of the quarter-wavelength resonators form a second signal path, in which a second signal travels through a capacitive coupling path between the first and second arms.

10. The compact microstrip bandpass filter of claim 9, wherein the capacitive coupling gives rise to a second transmission pole a passband of the bandpass filter.

11. The compact microstrip bandpass filter of claim 3, wherein a second end of at least one of said first arms forms a capacitor in a middle section.

12. The compact microstrip bandpass filter of claim 11, wherein said middle section of at least one of said first arms is coupled with a first end of a second arm.

13. The compact microstrip bandpass filter of claim 11, wherein the at least one of said first arms and at least one of the second arms and the middle section of the at least one of said first arms are curved around the resonant disk with different radii.

14. The compact microstrip bandpass filter of claim 13, wherein a second end of said at least one of the second arms has the opposite curvature and the same radii as said curved first arms.

15. The compact microstrip bandpass filter of claim 1, wherein said plurality of layers comprises four layers.

16. The compact microstrip bandpass filter of claim 15, wherein a top layer of said four layers is a first metallic layer which contains a pattern of the compact microstrip bandpass filter.

17. The compact microstrip bandpass filter of claim 16, wherein a bottom layer of said four layers is a second metallic layer which is used as a ground layer.

18. The compact microstrip bandpass filter of claim 17, wherein two dielectric layers of said four layers are positioned between the top layer and the bottom layer.

19. The compact microstrip bandpass filter of claim 18, wherein a first dielectric layer of the two dielectric layers is used as a dielectric substrate.

20. The compact microstrip bandpass filter of claim 19, wherein a second reflection pole in a passband of the bandpass filter and a transmission pole in a stopband of the bandpass filter are formed when the open stub is attached to said joint point.

21. The compact microstrip bandpass filter of claim 19, wherein a second dielectric layer of the two dielectric layers is a passivation layer positioned between said first metallic layer and said first dielectric layer.

22. The compact microstrip bandpass filter of claim 21, wherein said second dielectric layer is an optional layer and protects electric properties of said first dielectric layer.

23. The compact microstrip bandpass filter of claim 1, wherein the quarter-wavelength resonators are cascaded and introduce a first reflection pole in a passband of the bandpass filter.

24. The compact microstrip bandpass filter of claim 23, wherein a resonant frequency of the open stub formed by the resonant disk and the microstrip line is close to a frequency of said first reflection pole.

25. A method of forming two signal paths in a compact microstrip bandpass filter comprising the steps of:

forming a first signal path between an input terminal and an output terminal of said filter with a plurality of quarter-wavelength resonators with a resonant disk and a microstrip line which connects the resonant disk to a joint point of the quarter-wavelength resonators, wherein the resonant disk and the microstrip line form an open stub, which is connected to the joint point where a rounded corner is used to connect the open stub to the joint point and the width of the microstrip line of the open stub is increased to reduce surface current density at the joint point and through the open stub, and forming a second signal path of the quarter-wavelength resonators, said filter includes a plurality of layers.

26. The method of claim 25, wherein a first signal of said first signal path travels through a coupling path between a first arm and a second arm of the quarter-wavelength resonators.

27. The method of claim 25, wherein the second signal path is formed with two arms of the quarter-wavelength resonators, wherein a second signal of said second signal path travels through a capacitive coupling path between the two arms.

28. The method of claim 25, wherein a relative signal phasing between said first signal path and said second signal path is tunable by changing a relative position of two arms in each quarter-wavelength resonator.

29. A method for forming a compact microstrip bandpass filter comprising the steps of:

providing an input terminal, an output terminal, a plurality of quarter-wavelength resonators, a resonant disk, a plurality of layers, and a microstrip line for connecting the resonant disk to a joint point of the quarter-wavelength resonators where a rounded corner is used to connect the open stub to the joint point and the width of the microstrip line of the open stub is increased to reduce surface current density at the joint point and through the open stub.

* * * * *